US011505974B2

(12) United States Patent
Nitzsche

(10) Patent No.: US 11,505,974 B2
(45) Date of Patent: Nov. 22, 2022

(54) SECURED EQUIPMENT CARRIER HOLDING DEVICE AND RAIL VEHICLE WITH AN EQUIPMENT CARRIER HOLDING DEVICE

(71) Applicant: Siemens Mobility GmbH, Munich (DE)

(72) Inventor: Christian Nitzsche, Ismaning (DE)

(73) Assignee: Siemens Mobility GmbH, Munich (DE)

( * ) Notice: Subject to any disclaimer, the term of this patent is extended or adjusted under 35 U.S.C. 154(b) by 468 days.

(21) Appl. No.: 16/705,607

(22) Filed: Dec. 6, 2019

(65) Prior Publication Data

US 2020/0181957 A1 Jun. 11, 2020

(30) Foreign Application Priority Data

Dec. 6, 2018 (DE) ..... 102018221151

(51) Int. Cl.
*E05C 5/04* (2006.01)
*E05C 3/08* (2006.01)
(Continued)

(52) U.S. Cl.
CPC ..... *E05C 3/08* (2013.01); *B61D 19/026* (2013.01); *E05B 17/2046* (2013.01); *Y10T 292/1099* (2015.04)

(58) Field of Classification Search
CPC ..... Y10S 292/15; Y10T 292/0847; Y10T 292/0998; Y10T 292/1026; Y10T 292/1033; Y10T 292/1087; Y10T 292/1094; Y10T 292/20; Y10T 292/214; Y10T 292/218; Y10T 292/221; Y10T 292/376; Y10T 292/382; Y10T 292/385; Y10T 292/426; E05B 65/006; E05B 9/082; E05B 2015/0215; E05B 17/2023; E05B 17/2046; E05B 17/2065; E05B 41/00; E05B 83/02; E05B 83/06; E05B 83/363;
(Continued)

(56) References Cited

U.S. PATENT DOCUMENTS 236,531 A * 1/1881 Barton ..... E05F 11/00 292/206
760,454 A * 5/1904 Hiser ..... E04H 13/00 27/35
(Continued)

FOREIGN PATENT DOCUMENTS

DE 2416263 A * 10/1974 ..... F16J 13/06
DE 2623540 A * 11/1977 ..... H05K 7/1407
(Continued)

*Primary Examiner* — Carlos Lugo
(74) *Attorney, Agent, or Firm* — Laurence A. Greenberg; Werner H. Sterner; Ralph E. Locher

(57) ABSTRACT

An equipment carrier holding device has a housing with a door. A screwing block is arranged in the housing. A clamping block and a fastening screw fix a fastening link of an item of equipment between the clamping block and the screwing block. The clamping block is positioned in relation to the door such that, in the event of incomplete arresting of the fastening screw, the fastening screw forms a mechanical barrier to complete closing of the door. A rail vehicle is also described which is equipped with such an equipment carrier holding device.

9 Claims, 3 Drawing Sheets

(51) Int. Cl.
*B61D 19/02* (2006.01)
*E05B 17/20* (2006.01)
*E05B 83/02* (2014.01)

(58) Field of Classification Search
CPC ..... B61D 19/00; B61D 19/001004; B61D 19/026; B65D 45/02; B65D 45/16; B65D 2251/1016; H05K 7/1407; H05K 2201/10409
USPC ..... 105/341, 377.11, 308.1, 309, 310, 310.1, 105/310.2, 313; 220/1.5, 328, 327, 325, 220/315, 833, 810
See application file for complete search history.

(56) References Cited

U.S. PATENT DOCUMENTS 1,615,300 A * 1/1927 Cantrell ..... E05B 65/006 292/256.75
3,018,127 A * 1/1962 Dobrosielski ..... F16J 13/18 411/166
3,514,005 A * 5/1970 Irwin ..... B65D 19/10 206/386
3,848,953 A * 11/1974 Petroshanoff ..... H05K 7/1407 361/801
4,860,913 A * 8/1989 Bertolini ..... B65D 88/121 410/145
4,915,557 A * 4/1990 Stafford ..... F16B 5/0208 411/258
5,397,176 A * 3/1995 Allen ..... G06F 1/18 70/164
5,462,188 A * 10/1995 Yurgevich ..... B65D 90/0013 206/511
6,147,872 A * 11/2000 Roy ..... H05K 7/1409 361/801
6,471,310 B2 * 10/2002 Montagna ..... G06F 1/185 361/801
6,708,625 B1 * 3/2004 Burke ..... E05B 83/06 292/168
10,837,207 B2 * 11/2020 Lorek ..... E05C 3/12

FOREIGN PATENT DOCUMENTS

DE 4309973 A1 * 9/1994 ..... H05K 7/1407
DE 29610693 U1 * 7/1997 ..... H05K 7/1407
DE 202004013072 U1 * 11/2004 ..... B63H 20/06
DE 102008006741 A1 * 8/2009 ..... H05K 7/1412
DE 102015013299 A1 4/2017
DE 102016224118 A1 * 6/2018 ..... H05K 5/0008
FR 1337983 A * 9/1963
FR 2599927 A1 * 12/1987

* cited by examiner

SECURED EQUIPMENT CARRIER HOLDING DEVICE AND RAIL VEHICLE WITH AN EQUIPMENT CARRIER HOLDING DEVICE

CROSS-REFERENCE TO RELATED APPLICATION

This application claims the priority, under 35 U.S.C. § 119, of German patent application DE 10 20 18 221 151, filed Dec. 6, 2019; the prior application is herewith incorporated by reference in its entirety.

BACKGROUND OF THE INVENTION

Field of the Invention

The invention relates to an equipment carrier holding device. The invention also relates to a rail vehicle.

Equipment carriers, for example in rail vehicles, have components or subassemblies that have to be detached or moved for maintenance purposes. It sometimes happens that the components detached by maintenance personnel are not properly attached after the maintenance work has been carried out, and their screws are not correctly tightened. If equipment carriers are not properly arrested, subassemblies can be lost or even collide with the infrastructure. For example, an incorrectly arrested sliding-compartment system of a rail vehicle may move laterally in relation to the traveling direction during the operation of the rail vehicle.

Equipment carriers equipped with linear systems often have arresting bolts. These are dimensioned according to the specific application, on the basis of strength and stress criteria. If a linear system is fitted without arresting bolts provided by the manufacturer, the components are separately screwed to holders especially designed for the purpose. In this case there is the risk that these components have not been installed completely and properly. In particular when there are constantly recurring maintenance operations, these holders or the associated screw material become misplaced. Often, the remaining material is then only poorly fitted again after the inspection. As a consequence, the design no longer conforms to the original strength rating and the system no longer satisfies the strength requirements.

SUMMARY OF THE INVENTION

It is accordingly an object of the invention to provide an equipment carrier, which overcomes the above-mentioned and other disadvantages of the heretofore-known devices and methods of this general type and which provides for a device with which improved reliability of the arresting of equipment carriers, in particular in rail vehicles, is achieved.

With the above and other objects in view there is provided, in accordance with the invention, an equipment carrier holding device, comprising:

a housing with a door;

a screwing block disposed in the housing;

a clamping block; and a fastening screw for fixing a fastening link of an equipment carrier between the clamping block and the screwing block;

wherein the clamping block is positioned relative to the door such that, on occasion that the fastening screw is incompletely arrested, the fastening screw forms a mechanical barrier to a complete closing of the door.

In other words, the equipment carrier holding device according to the invention has a housing with a door. The door allows access to the equipment carrier, for example in the case of a maintenance measure, and protects the equipment carrier from outside influences during regular operation. Part of the equipment carrier holding device according to the invention is also formed by a screwing block arranged in the housing and a clamping block. The screwing block serves as a basis for fixing the equipment carrier and is itself firmly connected to a vehicle comprising the equipment carrier holding device. With a fastening screw, a fastening link of the equipment carrier is fixed between the clamping block and the screwing block. The clamping block therefore performs the task of clamping jaws for the fixing of the equipment carrier on the screwing block. The clamping block is positioned in relation to the door in such a way that, in the event of incomplete arresting of the fastening screw, the fastening screw forms a mechanical barrier to complete closing of the door. When reference is made to a door of a housing in connection with the equipment carrier holding device, this is also intended to include other pivotable covering units, such as for example a flap or a lid.

In the event of defective attachment of the fastening screw, it is advantageously indicated by the door remaining partially open that the arresting of the equipment carrier has not been carried out correctly, which contributes to improved safety of the system as a whole. The maintenance personnel are alerted both visually and haptically to the need for correcting the attachment of the equipment carrier. If the maintenance personnel notice that the door cannot close properly, this indicates to them that the equipment carrier has not been attached properly.

The rail vehicle according to the invention has an equipment carrier holding device according to the invention and an item of equipment which is fixed in the equipment carrier holding device. The rail vehicle according to the invention shares the advantages of the combined equipment carrier holding device according to the invention.

The dependent claims and the description that follows respectively contain particularly advantageous refinements and developments of the invention. In particular, the claims of one category of claims may also be developed analogously to the dependent claims of another category of claims and the relevant parts of the description. Moreover, the various features of different exemplary embodiments and claims may also be combined within the scope of the invention to form new exemplary embodiments.

Preferably, the equipment carrier holding device according to the invention has a swivel bearing which is fastened to the screwing block and by which the clamping block is connected to the screwing block such that it can swivel in relation to the screwing block. The swivel arrangement of the clamping block achieves the effect that fastening parts no longer have to be completely removed or detached. It is sufficient that merely a screw, i.e. the fastening screw, is undone, in order to swing down the swivel-mounted clamping block. Advantageously, individual parts of the arrangement, in particular the clamping block and the fastening screw, cannot be lost so easily.

In a preferred refinement of the equipment carrier holding device according to the invention, the fastening screw has at its shaft end an external thread and the screwing block has an internal thread corresponding to the external thread of the fastening screw. With the aid of this thread, the clamping block can be fixed on the screwing block.

In a variant of the equipment holder carrying device according to the invention, the clamping block has an internal thread which is formed as a captive retaining device and corresponds to the external thread of the fastening screw and is designed to prevent falling out of the fastening screw from the clamping block. Advantageously, falling out of the fastening screw can be prevented with the aid of this retaining device, and loss of this component or damage to the thread of the fastening screw can consequently be prevented.

In a refinement of the equipment carrier holding device according to the invention, the internal thread is arranged on the side of the clamping block that is facing away from the screwing block and is dimensioned to match the external thread of the fastening screw. The dimensioning is such that the two threads engage in one another and removal of the screw from the clamping block is only possible by turning the screw in the internal thread of the clamping block. Falling out of the screw when a clamping block is undone from the equipment carrier can in this way be prevented.

With preference, the clamping block of the equipment carrier holding device according to the invention has a leg which corresponds to the swivel bearing and is swivel-connected to the swivel bearing. The leg serves as a connecting element between the clamping block and the swivel bearing arranged on the screwing block and serves as a swivel arm, in order before detachment of the equipment carrier to undo the clamping block from the latter.

In a special variant of the equipment carrier holding device according to the invention, the screwing block comprises on its side facing the door and the clamping block a first bore, which comprises the internal thread of the screwing block. Furthermore, the clamping block has a second bore, which in the fixed state is in line with the first bore and comprises the internal thread of the clamping block. Said bores serve for receiving the shaft of the fastening screw for fixing the equipment carrier between the clamping block and the screwing block.

In a refinement of the equipment carrier holding device according to the invention, when considered in the longitudinal direction, the internal thread of the screwing block is only formed on part of the first bore and in an inner region is formed away from the outer side of the screwing block. Advantageously, the fastening screw can be easily and quickly undone from the screwing block and also screwed again to it, so that the detachment and attachment of the equipment carrier is speeded up in comparison with a continuous thread.

In a further refinement of the equipment carrier holding device according to the invention, considered in the longitudinal direction, the internal thread of the clamping block is only formed on part of the second bore. Advantageously, here too an unscrewing or screwing in of the fastening screw can be carried out more quickly than in the case of a thread extending over the entire thickness of the clamping block.

Other features which are considered as characteristic for the invention are set forth in the appended claims.

Although the invention is illustrated and described herein as embodied in secured equipment carrier holding device, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings.

DETAILED DESCRIPTION OF THE INVENTION

Figure 1:
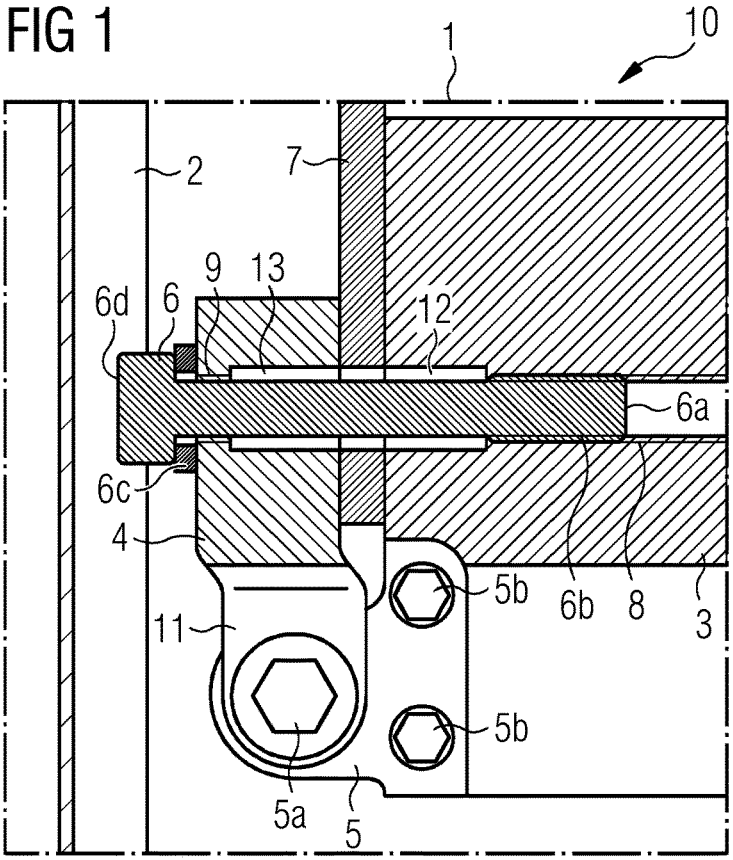
FIG. 1 shows a cross-sectional view of an equipment carrier holding device according to an exemplary embodiment of the invention in the closed state.

Referring now to the figures of the drawing in detail and first, in particular, to FIG. 1 thereof, there is shown a cross-sectional view of an equipment carrier holding device 10 according to an exemplary embodiment of the invention. The equipment carrier holding device 10 comprises a housing 1 with a door 2. In the housing 1 there is a screwing block 3, on which a fastening link 7 of an item of equipment to be held (not shown) is fixed with the aid of a clamping block 4. The clamping block 4 is mounted such that it can swivel in relation to the screwing block 3. For this purpose, a leg 11 of the clamping block 4 is connected with the aid of a pin Sa to a swivel bearing 5, which is fixed on the screwing block 3 with the aid of screws 5*b*. The clamping block 4 can be fixed on the screwing block 3 with the aid of a fastening screw 6 together with the fastening link 7. For this purpose, the fastening screw 6 has at its shaft end 6*a* an external thread 6*b*. Furthermore, the screwing block 3 comprises a bore 12 with an internal thread 8, into which the thread 6*b* of the fastening screw 6 can be screwed. The clamping block 4 is also formed with a bore 13, which in the attached state of the clamping block 4 is in line with the bore 12 of the screwing block 3. On the side of the bore 13 that lies in the direction of the door or in the direction of the screw head, it has a retaining thread 8, by which falling out of the fastening screw 6 is prevented when the equipment carrier holding device 10 is open, that is to say in the state in which the clamping block 4 releases the fastening link 7. Also arranged between the screw head 6*d* of the fastening screw 6 and the clamping block 4 is a washer 6*c*, in order to distribute the force of the screw head 6*d* over a greater area.

Figure 2:
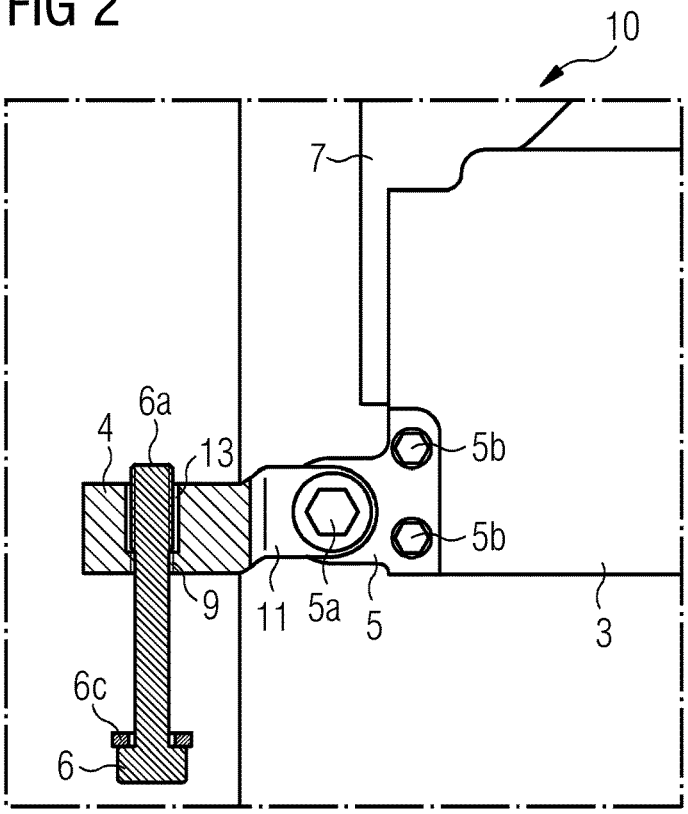
FIG. 2 shows a schematic cross-sectional view of the equipment carrier holding device shown in FIG. 1 in the open state.

In FIG. 2, the equipment carrier holding device 10 illustrated in FIG. 1 is shown in the opened state. In this case, the clamping block 4 has been swung away from the fastening link 7, so that the fastening link 7 can be removed. In the swung-up state, the fastening screw 6 has been unscrewed from the internal thread 8 of the bore 12 (cf. FIG. 1) of the screwing block 3 and due to gravitational force falls through the bore 13 of the clamping block until the external thread 6*b* of the fastening screw 6 meets the internal thread or retaining thread 8 of the clamping block 4 and the fastening screw 6 is hindered from falling out from the bore 13 of the clamping block 4 by the interlocking engagement with the internal thread 8 of the clamping block 4.

Figure 3:
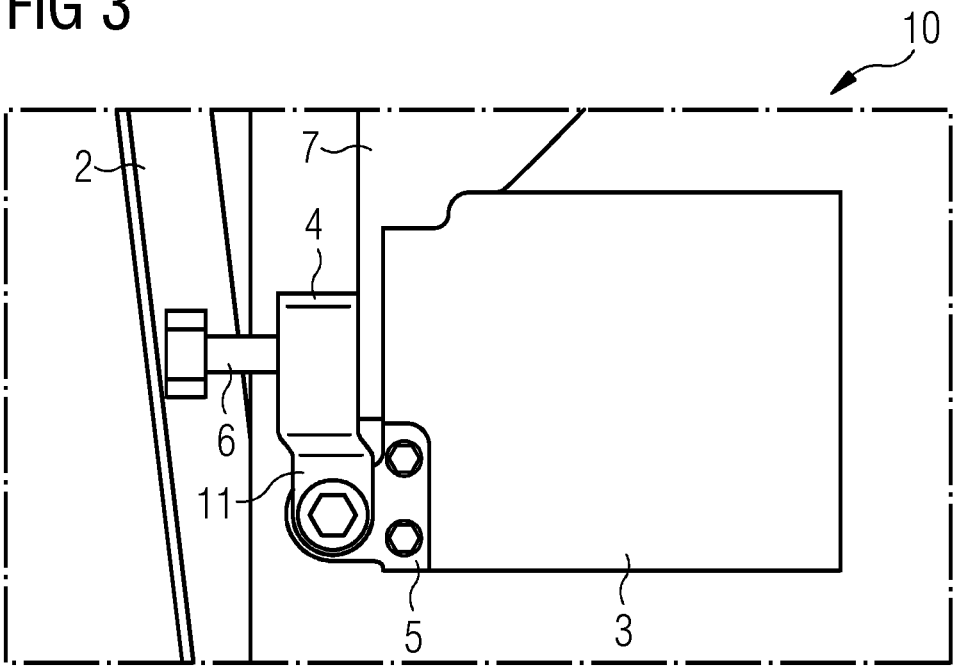
FIG. 3 shows a schematic side view of the arrangement shown in FIG. 1 and FIG. 2 with an incompletely screwed-in fastening screw according to an exemplary embodiment of the invention.

In FIG. 3, a schematic side view of the arrangement 10 shown in FIG. 1 and FIG. 2 with an incompletely screwed-in fastening screw 6 according to an exemplary embodiment of the invention is shown. In other words, the fastening screw 6 has not been fully screwed into the screwing block 3 for the equipment carrier 7. Such a state may occur for example due to an oversight on the part of the maintenance personnel, if the fastening screw 6 has inadvertently not been screwed into the screwing block 3 quite completely. In this situation, the protruding fastening screw 6 keeps the door 2 of the arrangement 10 slightly open, so that the maintenance personnel are warned both by the appearance and the mechanical state that the equipment carrier 7 is not properly fixed.

Figure 4:
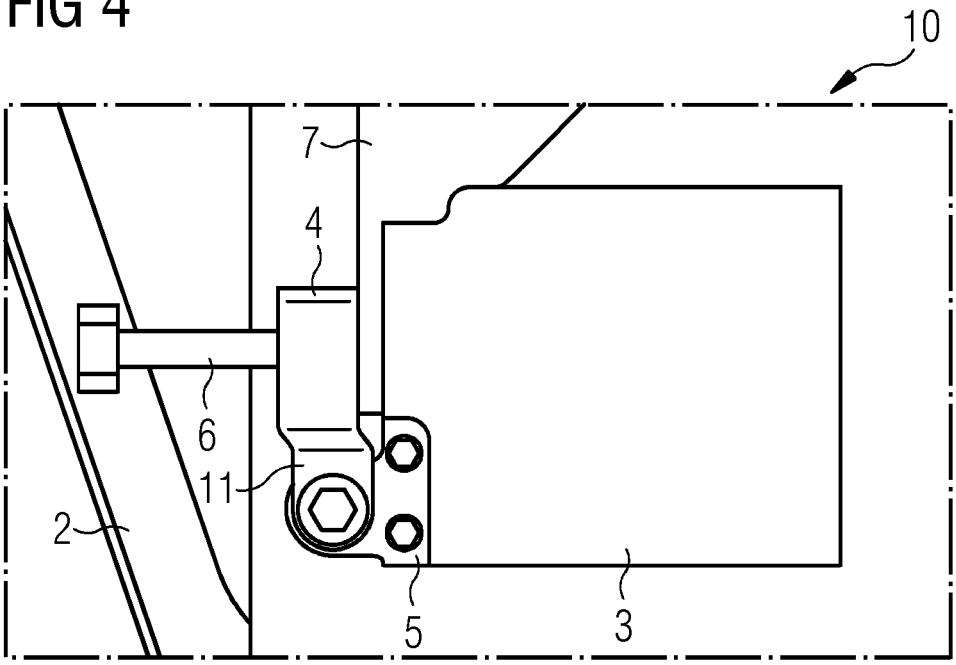
FIG. 4 shows a schematic side view of the arrangement shown in FIGS. 1 to 3 with the fastening screw only pushed into the bore of the clamping block.

In FIG. 4, a schematic side view of the arrangement 10 shown in FIGS. 1 to 3, with the fastening screw 6 only pushed into the bore 13 (see FIG. 1) of the clamping block 4, is shown. In this situation, the door 2 of the arrangement 10 is wide open, so that the maintenance personnel are warned of the defective attachment.

Figure 5:
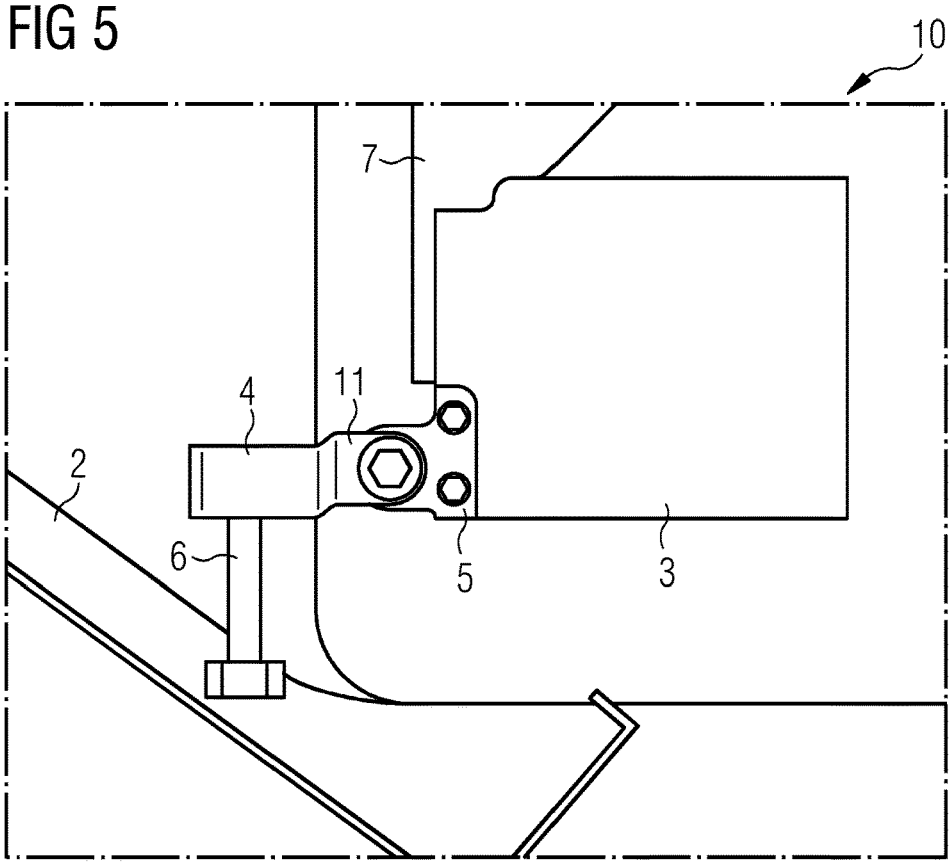
FIG. 5 shows a schematic side view of the arrangement shown in FIGS. 1 to 4 with the clamping block swung up.

Since the equipment carrier 7 in this situation is no longer held between the clamping block 4 and the screwing block 3 by frictional engagement, this can lead to the situation shown in FIG. 5, in which the clamping block 4 is swung away from the equipment carrier 7 and the fastening screw 6, drawn by gravitational force, falls through in the downward direction until it is hindered from falling out from the clamping block 4 by the captive retaining device that is formed by the internal thread 9 (see FIG. 1) of the clamping block 4. The situation shown in FIG. 5 also occurs when the maintenance personnel would like to remove the equipment carrier 7, and for this have to swing down the clamping block 4.

Figure 6:
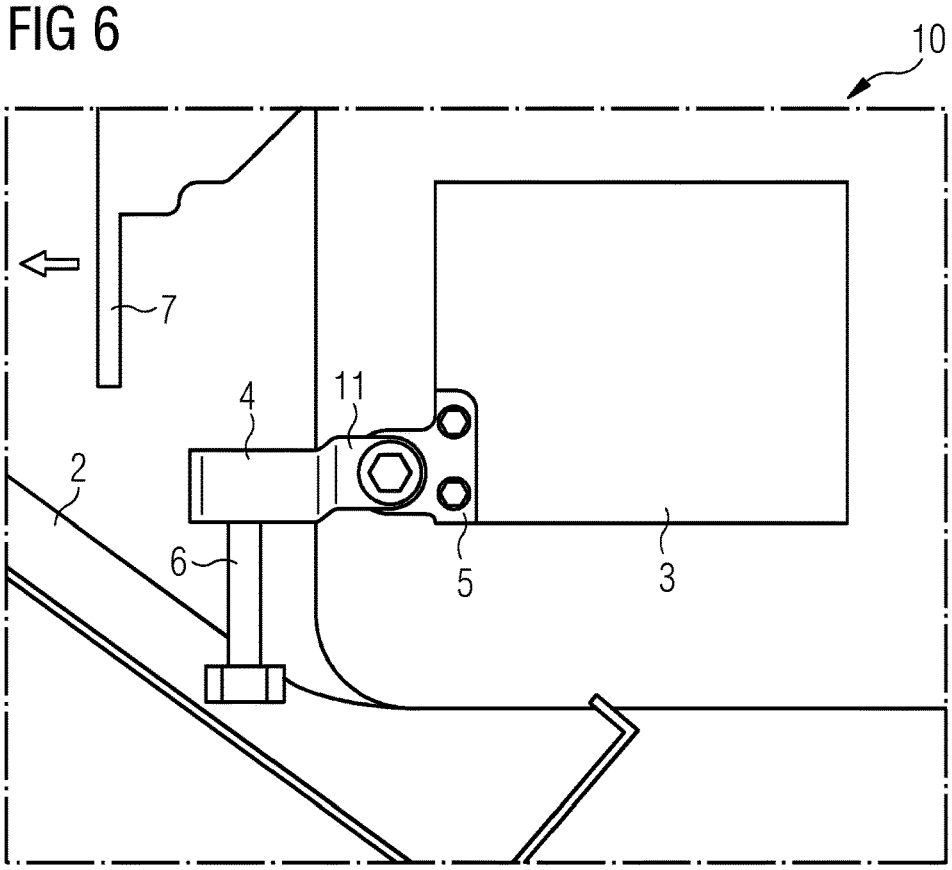
FIG. 6 shows a schematic side view of the arrangement shown in FIGS. 1 to 5 with the equipment carrier taken out.

FIG. 6 illustrates a situation in which the equipment carrier 7 is removed from the equipment carrier holding device 10 with the clamping block 4 swung away and the fastening screw 6 held in the captive retaining device 9 of the clamping block 4.

Finally, it is once again pointed out that the previously described methods and devices are merely preferred exemplary embodiments of the invention and that the invention can be varied those of skill in the pertinent art without departing from the scope of the invention, to the extent prescribed by the claims. It is also pointed out for the sake of completeness that the use of the indefinite article "a" or "an" does not exclude the possibility that the features concerned may also be present in multiple form. Similarly, the term "unit" does not exclude the possibility that it consists of multiple components, which may possibly also be spatially distributed.

The invention claimed is:

1. An equipment carrier holding device, comprising:

a housing with a door;

a screwing block disposed in said housing;

a clamping block;

a fastening screw for fixing a fastening link of an equipment carrier between said clamping block and said screwing block; and a swivel bearing fastened to said screwing block and configured to pivotally connect said clamping block to said screwing block;

said clamping block being positioned relative to said door such that, when said fastening screw is incompletely arrested, said fastening screw forms a mechanical barrier to a complete closing of said door.

2. The equipment carrier holding device according to claim 1, wherein said fastening screw has a shaft end with an external thread and said screwing block has an internal thread configured to mesh with said external thread of said fastening screw.

3. The equipment carrier holding device according to claim 2, wherein said clamping block has an internal thread which is formed as a captive retaining device and which corresponds to said external thread of said fastening screw and which is configured to prevent falling out of said fastening screw from said clamping block.

4. The equipment carrier holding device according to claim 3, wherein said internal thread is formed on a side of said clamping block that is facing away from said screwing block and is dimensioned to match said external thread of said fastening screw.

5. The equipment carrier holding device according to claim 1, wherein said clamping block has a leg which corresponds to said swivel bearing and is pivotally connected to said swivel bearing.

6. The equipment carrier holding device according to claim 3, wherein said screwing block, on a side facing said door and said clamping block, is formed with first bore containing said internal thread of said screwing block, and said clamping block has a second bore, which in a fixed state is in line with said first bore and contains said internal thread of said clamping block.

7. The equipment carrier holding device according to claim 6, wherein, along a longitudinal direction of said first bore, said internal thread of said screwing block is only formed on part of said first bore and in an inner region that is spaced apart from an outer side of said screwing block.

8. The equipment carrier holding device according to claim 6, wherein, along a longitudinal direction of said second bore, said internal thread of said clamping block is only formed on part of said second bore.

9. A rail vehicle, comprising:

an equipment carrier holding device according to claim 1; and an item of equipment disposed and fixed in said equipment carrier holding device.

* * * * *